US006104132A

United States Patent [19]

Nose et al.

[11] Patent Number: 6,104,132

[45] Date of Patent: Aug. 15, 2000

[54] COLOR CATHODE RAY TUBE

[75] Inventors: Hisashi Nose, Chiba; Mutsumi Maehara; Tsuyoshi Iwata, both of Mobara, all of Japan

[73] Assignee: Hitachi, Ltd., Tokyo, Japan

[21] Appl. No.: 08/814,642

[22] Filed: Mar. 10, 1997

[30] Foreign Application Priority Data

Mar. 11, 1996 [JP] Japan ..... 8-053156

[51] Int. Cl.[7] ..... H01J 29/07

[52] U.S. Cl. ..... 313/402; 313/407; 313/404

[58] Field of Search ..... 313/402, 403, 313/404, 405, 406, 407, 408

[56] References Cited

U.S. PATENT DOCUMENTS

| | | |
|---|---|---|
| 4,056,755 | 11/1977 | Sohn . |
| 4,286,189 | 8/1981 | Koizumi et al. . |
| 4,308,485 | 12/1981 | Ignazio . |
| 4,645,968 | 2/1987 | Ragland et al. . |
| 4,743,371 | 5/1988 | Bauder . |
| 4,748,371 | 5/1988 | Bauder . |
| 5,315,208 | 5/1994 | Van Der Bolt . |

FOREIGN PATENT DOCUMENTS

| | | |
|---|---|---|
| 58-134111 | 8/1983 | Japan . |
| 60-40942 | 3/1985 | Japan . |
| 61-64146 | 3/1986 | Japan . |
| 62-223949 | 1/1987 | Japan . |
| 62-71150 | 4/1987 | Japan . |
| 62-170127 | 7/1987 | Japan . |
| 63-250039 | 10/1988 | Japan . |
| 5-114367 | 5/1993 | Japan . |
| 06012888 | 2/1994 | Japan . |
| 6-198415 | 8/1994 | Japan . |

*Primary Examiner*—Ashok Patel
*Attorney, Agent, or Firm*—Antonelli, Terry, Stout & Kraus, LLP

[57] ABSTRACT

A color cathode ray tube comprises a vacuum envelope in which there is mounted a shadow mask having a curved surface having a plurality of electron beam passing holes and a skirt extending downward from the margin of the curved surface. The shadow mask is supported by a mask frame having a substantially rectangular side wall. A shadow mask assembly constituted by fitting and securing the skirt into the side wall is set in the panel of the envelope, and the skirt is fitted and secured into the side wall by curving the middles of two or four facing sides of the skirt inward. Thereby, it is possible to provide a color cathode ray tube having the shadow mask assembly capable of obtaining a superior magnetic shielding characteristic by enlarging the effective region of the curved surface of the shadow mask.

21 Claims, 14 Drawing Sheets

COLOR CATHODE RAY TUBE

BACKGROUND OF THE INVENTION

The present invention relates to a color cathode ray tube, and particularly to a color cathode ray tube in which the effective region of a shadow mask is enlarged and the magnetic shielding characteristic and the howling prevention characteristic for assembling the shadow mask are improved.

A color cathode ray tube generally comprises a vacuum envelope (glass bulb) provided with a panel which is arranged to close the front side and on which a fluorescent screen is formed, a slender neck portion which is arranged at the rear side and in which an electron gun is mounted, and a funnel connecting the panel and the neck portion. A shadow mask assembly is fixed in front of the panel inside the envelope; a magnetic shield is set in the tube in the vicinity of the joint between the panel and the funnel; and a deflection yoke is set to surround the tube at the joint between the funnel and the neck portion. Moreover, the shadow mask assembly includes a shadow mask having a surface curved toward the panel, and in which a plurality of electron beam passing holes are formed, and a skirt extending away from the margin of the curved surface, and a mask frame having a flange connected to a substantially rectangular side wall and to the magnetic shield, which is constituted by fitting and securing the skirt to the side wall. Moreover, the shadow mask assembly is secured in the panel so that the curved surface of the shadow mask faces the fluorescent screen formed on the front panel.

In the case of a color cathode ray tube having the above structure, three electron beams are emitted from three electron guns included in the neck portion of the envelope and the three beams are properly deflected by a magnetic field generated by the deflection yoke. Then, the three electron beams pass through the electron beam passing holes formed on the curved surface of the shadow mask and, thereafter, each of them is projected on a phosphor region having a corresponding color on the fluorescent screen. Thus, a multi-color image is displayed on the front panel of the color cathode ray tube.

FIG. 15 is a top view showing the structure of a shadow mask assembly of the type used for an already-known color cathode ray tube.

In FIGS. 15 and 16A and 16B, symbol 40 generally denotes a shadow mask assembly, 41 generally denotes a shadow mask, 42 denotes a curved surface, 43 denotes a skirt, 44 generally denotes a mask frame, 45 denotes a side wall of the mask frame, 46 denotes a spring for supporting the shadow mask assembly in the panel of the tube envelope, 47 denotes a boss formed on the side wall of the mask frame and directed toward the inside of the frame, and 48 denotes a flange of the mask frame.

Moreover, the shadow mask 41 includes the curved surface 42 having a plurality of electron beam passing holes (not illustrated) and the skirt 43 extending from the margin of the curved surface 42. The mask frame 44 has the side wall 45 and the flange 48 which are connected to each other or press-molded into a rectangular shape. The spring 46 for supporting the mask frame 44 in the panel is attached to the outside of the side wall 45. Moreover, the mask frame has a plurality of bosses 47 for reinforcing the mechanical strength of the side wall 45 and for compensating for the clearance of the joint face between the side wall 45 and the skirt 43. The skirt 43 of the shadow mask 41 is fitted to the side wall 45 of the mask frame 44, and the skirt 43 and the side wall 45 are spot-welded to each other at several locations.

FIG. 16A is a sectional view of a major side of the shadow mask shown in FIG. 15, and FIG. 16B is a sectional view of a corner of the shadow mask assembly shown in FIG. 15. When the shadow mask 41 is press molded, a warp occurs due to springback because of the press-molding. The warp value SB of the skirt 43 usually tends to decrease at the corners with a relatively large degree of contraction due to press-molding and to increase at the central portion with a relatively small degree of contraction. The bottom margin of the skirt of the shadow mask 41 after being press-molded has a shape in which the middle of the side is slightly curved outward compared to the portion near a corner due to the warping. When fitting the skirt 43 of the shadow mask 41 into the side wall 45 of the mask frame 44, there is a problem that the skirt 43 contacts the side wall 45 of the frame 44 at the middle of a side thereof, while a clearance 49 is produced between the skirt 43 of the shadow mask 41 and the mask frame 44 at a corner.

Moreover, the margin of the curved surface 42 is molded so that the middle of a side is slightly curved outward in accordance with the shape of the margin of the glass panel. That is, to fit the skirt 43 to the side wall 45 of the mask frame, the dimensions of various portions of the shadow mask 41 are set so that the middle of a side of the skirt 43 just meets the side wall 45.

Moreover, when fitting the skirt 43 of the shadow mask 41, which has been press-molded at the above dimensions, into the side wall 45 of the mask frame 44, the clearance between the skirt 43 and the side wall 45 decreases at the middle of a side of the skirt 43 and increases at the corners of the skirt 43. Therefore, as shown in FIG. 15, a boss 47 is formed at each corner of the side wall 45 so as to compensate for the increasing clearance. A boss 47 is also properly formed at the middle of a side of the side wall 45 in order to reinforce the mechanical strength of the side wall 45.

Thus, the well-known shadow mask assembly 40 is molded so that the middle of a side of the margin of the curved surface 42 is slightly curved toward the outside when press-molding the shadow mask 41. Therefore, the clearance between the skirt 43 and the side wall 45 increases at the corners of the skirt 43. Moreover, problems occur in that it is necessary to form a boss 47 at each corner of the side wall 45, so that the effective region of the curved surface 42 relative to the size of the mask frame 44 is narrowed by a value equivalent to the increase in the clearance.

Furthermore, in the case of the well-known shadow mask assembly 40, the contact area between the skirt 43 and the side wall 45 is restricted to the arranged portion of the boss 47 at each corner. Therefore, the contact area between the skirt 43 and the side wall 45 is substantially small. In addition, because the contact area is small at the corners, there is a problem that an effective magnetic shielding characteristic cannot be obtained.

The present invention is made to solve the above problems and its object is to provide a color cathode ray tube comprising a shadow mask assembly which is capable of enlarging the effective region of the curved surface thereof to the size of the mask frame of the shadow mask assembly, thereby obtaining a superior magnetic shielding characteristic.

Though U.S. Pat. No. 4,308,485 discloses an example of the prior art, it does not suggest the present invention. Moreover, Japanese Utility Model Application No. 40942/1985 discloses a prior art arrangement, in which springback when forming a shadow mask is considered. However, neither the shape of the mask frame for holding the shadow mask nor the positional relation between the shadow mask and the mask frame are disclosed at all.

SUMMARY OF THE INVENTION

To achieve the above object, the present invention mainly comprises the following features.

(1) The side of the margin of the curved surface of a substantially rectangular shadow mask is set so that it is curved inward. That is, the side is set to a curvature which is convex to (toward) the tube axis of the cathode ray tube. Moreover, the substantially rectangular side wall of a mask frame is set so as to be linear or so as to have a curvature which is concave toward the tube axis of the cathode ray tube. Thereby, it is possible to obtain a sufficient clearance between the mask frame and the shadow mask for major and minor axes of the rectangle. Thus, it is possible to retain the mass productivity of the shadow mask even if the clearance is small on the diagonal axis. Moreover, it is possible to improve the magnetic shielding effect (effect of shielding against magnetism from outside the cathode ray tube) on the diagonal of a screen where the influence of geomagnetism is maximized. Furthermore, it is possible to increase the diagonal effective diameter of the screen by a value equivalent to the decrease of the clearance due to the diagonal axis.

(2) The side of the margin of the curved surface of a substantially rectangular shadow mask is set so as to be linear or to have a radius of curvature in which the side is curved outward and the radius of curvature of the side of the margin of the shadow mask is made larger than that of the inside of the side wall of a mask frame corresponding to the side of the margin of the shadow mask. Thereby, because a sufficient clearance is obtained between the mask frame and the shadow mask for major and minor axes of the above rectangle, it is possible to retain the mass productivity of a shadow mask assembly by decreasing the clearance on the diagonal axis of the rectangle.

(3) Because a boss is formed at a portion including the root on which the flange of the side wall of the mask frame is set and the skirt of the shadow mask is secured on the boss, it is possible to maintain the mechanical strength of the mask frame, increase the effective diameter of the shadow mask, and, moreover, to improve the magnetic coupling between the shadow mask and the mask frame.

(4) The clearance between the mask frame and the margin of the shadow mask is decreased at the corners and a boss is provided from the proximal edge of the side wall with the flange at the side of the mask frame up to the distal edge of the side wall to decrease the clearance at this portion. Thus, because the small region of the clearance is limited, it is possible to retain the mass productivity of a shadow mask assembly and obtain the advantages indicated in the above Items (1) to (3).

Therefore, according to the above features, the curved surface of a shadow mask is substantially enlarged at the corners and the effective region of the curved surface is expanded. Moreover, because the contact area between the skirt and the side wall is expanded at the corners, the magnetic shielding characteristic is improved at the corners of the shadow mask assembly.

DESCRIPTION OF THE PREFERRED EMBODIMENTS

The preferred embodiments of the present invention will be described below with reference to the accompanying drawings.

Figure 1:
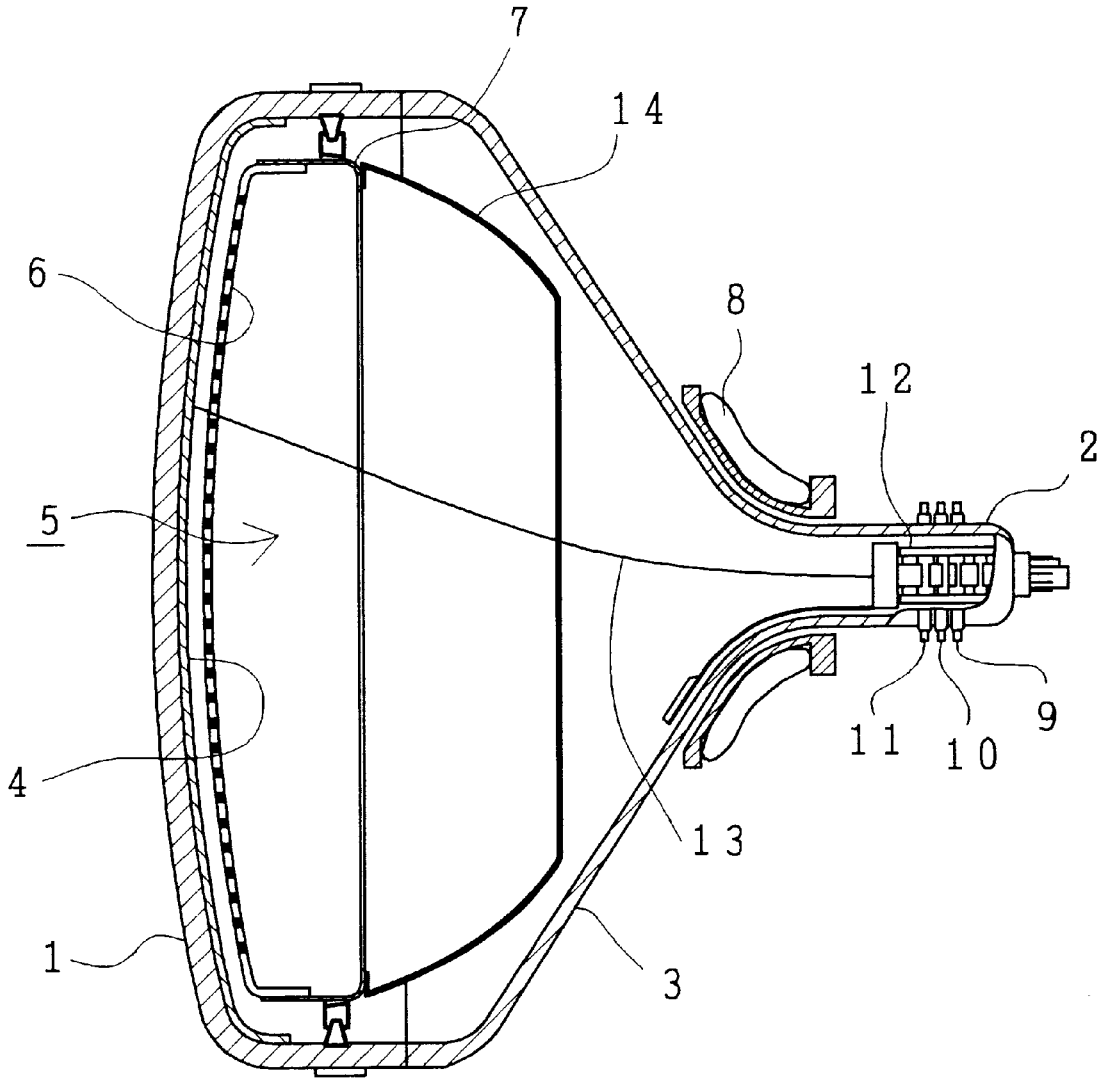
FIG. 1 is a schematic sectional view showing an embodiment of a color cathode ray tube in accordance with the present invention.

FIG. 1 is a schematic sectional view showing an embodiment of a color cathode ray tube according to the present invention.

In FIG. 1, symbol 1 denotes a panel, 2 denotes a neck, 3 denotes a funnel, 4 denotes a fluorescent screen, 5 denotes a shadow mask assembly, 6 denotes a shadow mask made of invar or AK (aluminium-killed), 7 denotes a mask frame made of mild steel or stainless steel, 8 denotes a deflecting yoke, 9 denotes a purity adjusting magnet, 10 denotes a center-beam static convergence adjusting magnet, 11 denotes a side-beam static convergence adjusting magnet, 12 denotes an electron gun, 13 denotes an electron beam, and 14 denotes a magnetic shield.

Moreover, a color cathode ray tube constitutes a vacuum envelope (glass bulb) formed by the panel 1, which is arranged at the front side and on which the fluorescent screen 4 is formed, the slender neck 2, which is arranged at the rear side and in which the electron gun 12 is included, and the funnel 3 connecting the panel 1 and the neck 2.

The shadow mask 6 is provided with a curved surface having a plurality of electron beam passing holes and a skirt extending from the margin of the curved surface, and the mask frame 7 is provided with a flange 71 and a substantially rectangular side wall when viewed from the panel side.

The shadow mask assembly 5 arranged in the panel 1 is constituted by the shadow mask 6 and the mask frame 7, the skirt of the shadow mask 6 being fitted and secured to the inside of the side wall of the mask frame 7 so that the shadow mask 6 and the mask frame 7 are integrally constituted. The shadow mask assembly 5 is arranged in the panel portion so that the curved surface of the shadow mask 6 is convex and directed toward the fluorescent screen 4.

The magnetic shield 14 is arranged in the tube envelope constituting the color cathode ray tube, and the deflecting yoke 8 is set outside of the tube at the joint between the funnel 3 and the neck 2. The purity adjusting magnet 9, the center-beam static convergence adjusting magnet 10, and the side-beam static convergence adjusting magnet 11 are arranged outside of the neck 2. Three electron beams 13 (only one electron beam is shown in FIG. 1) emitted from the electron gun 12 are deflected in a predetermined direction by a magnetic field generated by the deflecting yoke 8 and, thereafter, they pass through a plurality of electron beam passing holes formed in the shadow mask 6 and respectively reach a picture element of a corresponding color on the fluorescent screen 4.

The operation of the color cathode ray tube having the above structure, that is, the image display operation, is the same as that of a well-known color cathode ray tube.

First Embodiment

Figure 2:
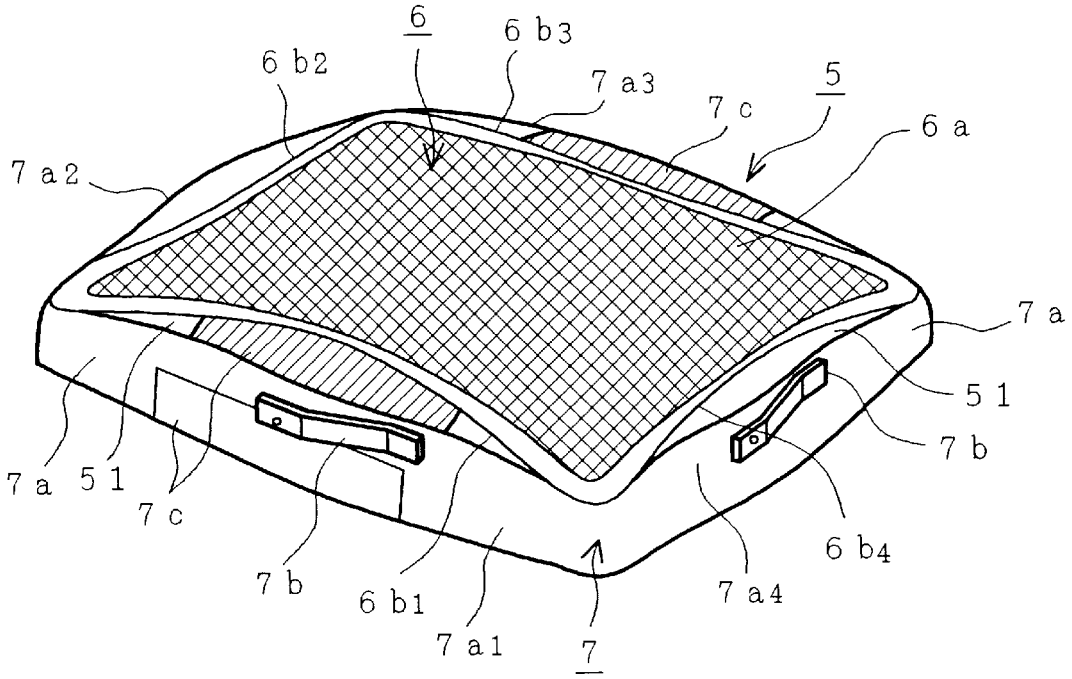
FIG. 2 is a perspective view showing an embodiment of the structure of a shadow mask assembly used for the color cathode ray tube shown in FIG. 1.
Figure 3:
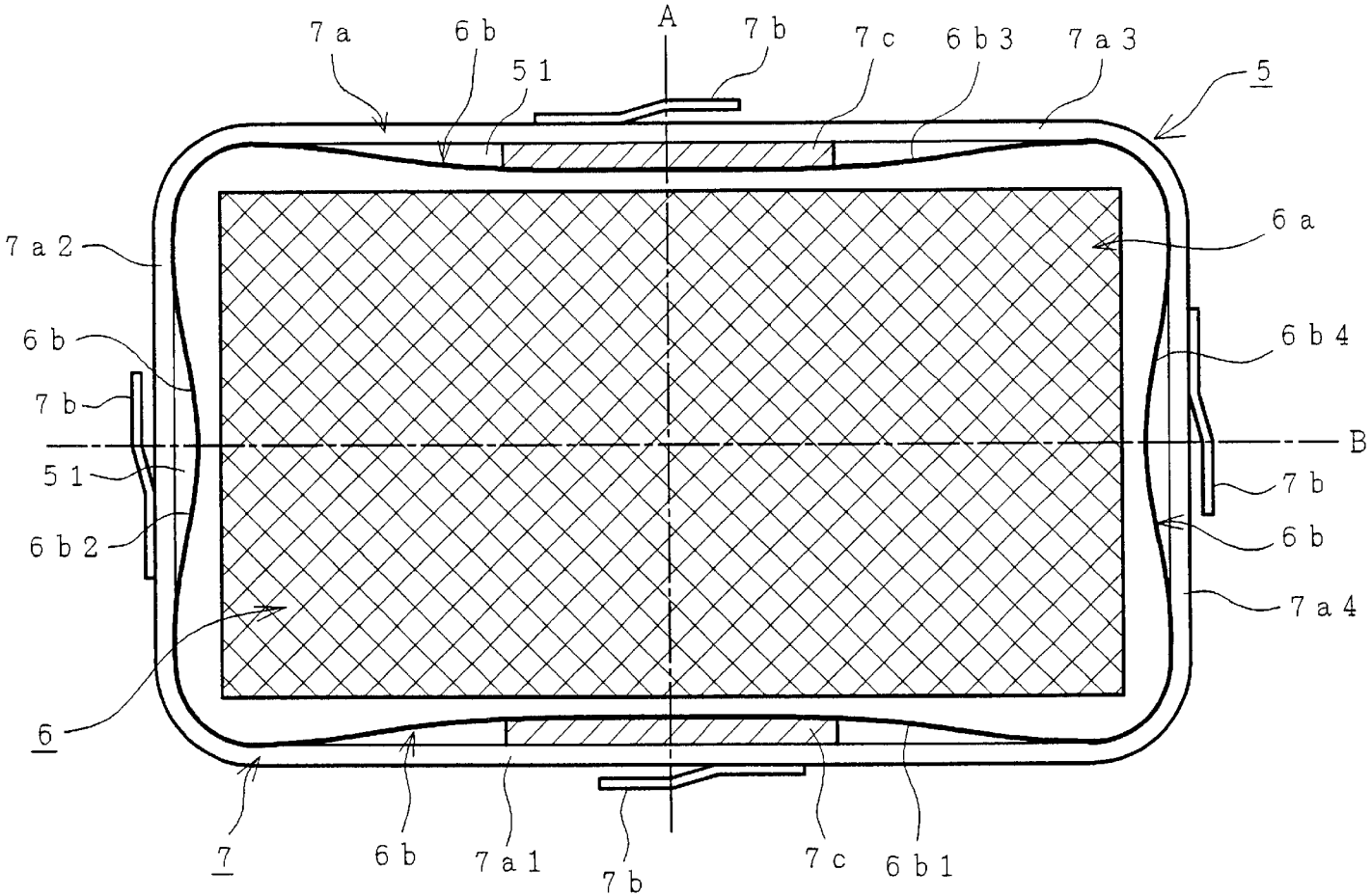
FIG. 3 is a top view of the shadow mask assembly shown in FIG. 2.

FIG. 2 is a perspective view showing an example of the shadow mask 5 used for the color cathode ray tube shown in FIG. 1, and FIG. 3 is a top view of the shadow mask assembly 5 shown in FIG. 2.

In FIGS. 2 and 3, symbol 6*a* denotes a curved surface of the shadow mask 6, 6*b* denotes a skirt of the shadow mask assembly 6, $6b_1$, $6b_2$, $6b_3$, and $6b4_4$ denote four sides of the skirt 6*b*, 7*a* denotes a side wall of the mask frame 7, $7a_1$, $7a_2$, $7a_3$, and $7a_4$ denote four sides of the side wall 7*a*, 7*b* denotes a spring, and 7*c* denotes a boss formed on the mask frame 7. In FIGS. 2 and 3, other components which are the same as those shown in FIG. 1 are provided with the same symbol. The axis A is an axis passing through the center of the shadow mask assembly and is substantially parallel with a minor side of the assembly and the axis B is an axis passing through the center of the shadow mask assembly and is substantially parallel with a major side of the assembly.

Moreover, the shadow mask 6 includes the curved surface 6*a* having an effective region in which a plurality of electron beam passing holes (not illustrated) are formed and the skirt 6*b* extending downward from the margin of the curved surface 6*a*. The mask frame 7 has the side wall 7*a* formed to be substantially rectangular by the four sides $7a_1$, $7a_2$, $7a_3$, and $7a_4$ and the flange 71 to which a magnetic shield is set. The spring 7*b* is set outside of the side wall 7*a* and the boss 7*c* is formed inside of the side wall 7*a*.

To form the skirt 6*b* on the shadow mask 6 by press-molding, the four sides $6b_1$, $6b_2$, $6b_3$, and $6b_4$ of the skirt 6*b* are molded so that the middle of each side is curved slightly inward (central direction of the shadow mask 6) from the side nearby a corner of the skirt. For example, in the case of the curved portion, the vicinity of the intersections between the major side 6*b*, or $6b_3$ of the skirt and the axis A is curved most inward and symmetrically to the right and left of the intersection.

Moreover, the boss 7*c* of the frame 7 is formed on the axis A or at a position nearby the axis A so as to face the curved portion of the skirt.

To relatively increase the clearance 51 between the sides when fitting the skirt 6*b* of the shadow mask into the side wall 7*a* of the mask frame at the middle of each side and to relatively decrease it at each side nearby a corner, the boss 7*c* is formed at the middle of each of the four sides $7a_1$, $7a_2$, $7a_3$, and $7a_4$ (position facing a portion of the skirt curved inward), but the boss 7*c* for welding is not formed at the four corners formed by the four sides $7a_1$, $7a_2$, $7a_3$, and $7a_4$. The weld between the skirt and the mask frame is located in the vicinity of the middle of each side and at the corners.

At the corners, the curvatures of the inner surface of the frame and that of the skirt 6*b* are almost the same or the curvature of the skirt is smaller than that of the inner surface of the frame in order to increase the contact area between the side wall 7*a* and the skirt 6*b*.

Moreover, the contact area between the side wall 7*a* and the skirt 6*b* is a region which reaches each side constituting a range from corner to corner having a curvature. At the contact area, the bottom margin of the skirt is allowed to contact the side wall 7*a* at the contact area of a corner or the top margin of the skirt is allowed to contact the side wall 7*a*. Moreover, it is best if the skirt contacts the side wall 7*a* at the whole surface of a corner.

It is possible to weld the boss 7*c* to the inside of the side wall 7*a* or to form the boss 7*c* by press-molding the side wall 7*a* inward.

By forming the above structure, the clearance between the skirt 6*b* and the middle of a side of the side wall 7*a* relatively increases at the facing planes between the four sides $6b_1$, $6b_2$, $6b_3$, and $6b_4$ of the skirt 6*b* of the shadow mask of the shadow mask assembly 5 on the one hand and the four sides $7a_1$, $7a_2$, $7a_3$, and $7a_4$ of the side wall 7*a* of the mask frame on the other hand, and so the clearance at a corner relatively decreases. That is, the clearance at a corner is smaller than the clearance near the middle of a side. Thereby, it is possible to adequately secure the contact area between the skirt 6*b* and the side wall 7*a* at the corner between the skirt 6*b* and the side wall 7*a* and thereby, it is unnecessary to provide a boss at the corners of the side wall 7*a*.

Moreover, because it is unnecessary to provide a boss at the corners of the side wall 7*a*, the curved surface 6*a* of the shadow mask 6 substantially expands at the corners and, thereby, it is possible to expand the effective region of the curved surface 6*a* up to a value equivalent to the expansion of the curved surface 6*a*. Therefore, it is possible to form a corner into a square corner. Furthermore, because the contact area between the skirt 6*b* and the side wall 7*a* increases at the corners, it is possible to improve the magnetic shielding characteristic at the corners of the shadow mask assembly 5. When the magnetic shielding characteristic is improved, the focus characteristic at the corners is also improved.

The important point of the present invention is that the skirt of a shadow mask entirely contacts (closely contacts) the side wall of a frame at the corners.

That is, the shadow mask has a curved surface having electron beam passing holes at its central portion and a skirt folded from the margin of the curved surface and extending in the tube axis direction, so that a top view of the margin projected on a plane vertical to the tube axis exhibits a substantially rectangular shape whose major or minor side has a curvature convex toward the tube axis. Moreover, the mask frame is substantially rectangular and its cross section is substantially L-shaped, and the frame includes a side wall extending in the tube axis direction and a flange extending transverse to the tube axis so that a top view obtained by projecting the inside of an end of the side wall at the fluorescent screen side on a plane transverse to the tube axis shows a substantially rectangular shape whose major or minor side is linear or has a curvature concave toward the tube axis. Moreover, the skirt of the shadow mask is secured to the inside of the side wall of the mask frame.

Figure 4A:
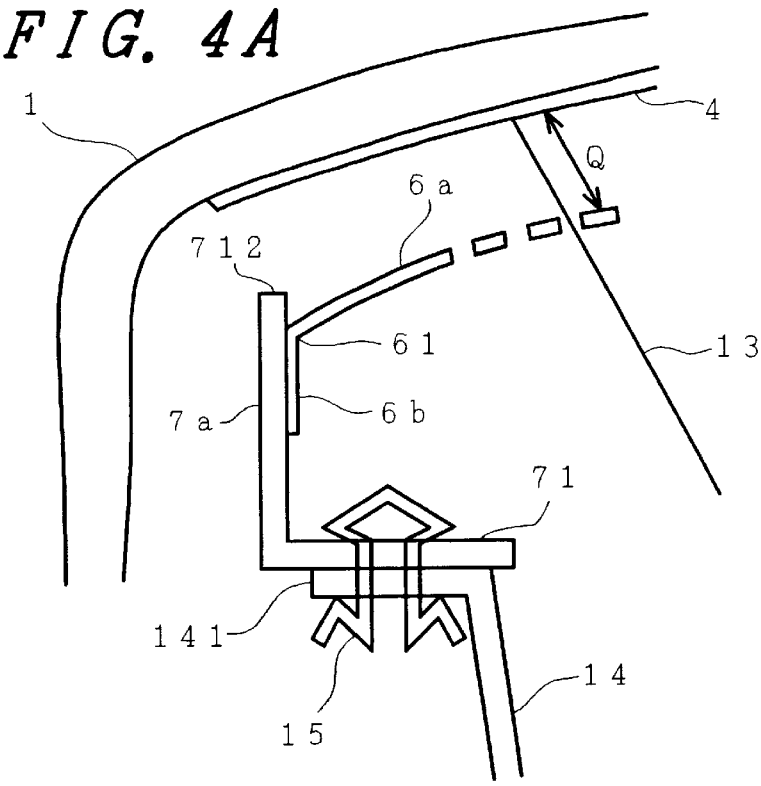
FIG. 4A is a diagrammatic view of a corner showing an embodiment when mounting the shadow mask assembly shown in FIG. 2 on a color cathode ray tube.
Figure 4B:
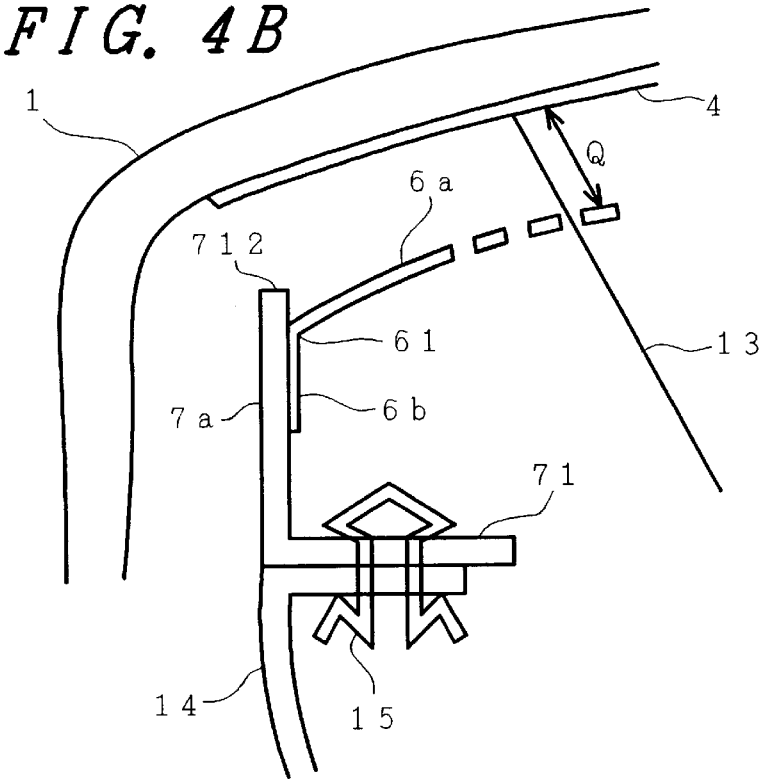
FIG. 4B is a diagrammatic view of a corner showing another embodiment when mounting the shadow mask assembly shown in FIG. 2 on a color cathode ray tube.

FIG. 4A is a detailed view of a corner showing an example of the arrangement of the shadow mask assembly of this embodiment in a color cathode ray tube. FIG. 4B is a similar view of a corner showing another example of a shadow mask assembly of this embodiment in a color cathode ray tube.

According to this embodiment, because it is unnecessary to form a boss at the corners, it is possible to enlarge the flange 7 of the mask frame, to effect close contact of a shadow mask and a magnetic shield to each other at the corners, to improve the magnetic coupling, and particularly to improve the beam landing tolerance at the corners of the screen where the influence of geomagnetism is maximized.

The method for coupling the shadow mask and the magnetic shield in FIG. 4A or 4B involves forming a hole in the flange 71 of the mask frame and in the flange 141 of the magnetic shield, respectively, and securing the flanges by inserting a securing spring 15 through the holes.

Moreover, because the front end 712 of the side wall of the mask frame extends beyond the margin 61 of the curved surface of the shadow mask at the corners, the effect of shielding external magnetism at the corners is further improved. Moreover, if the front end 712 of the side wall of the mask frame extends beyond the margin 61 of the curved surface of the shadow mask over the whole circumference, it is possible to improve the effect of shielding external magnetism (particularly, geomagnetism) over the whole circumference.

Furthermore, because it is unnecessary to form a boss at the corners, it is possible to form an effective portion of the shadow mask which corresponds to an effective screen portion and on which electron beam passing holes are formed up to the margin and to expand the effective screen portion in the diagonal direction.

Figure 5A:
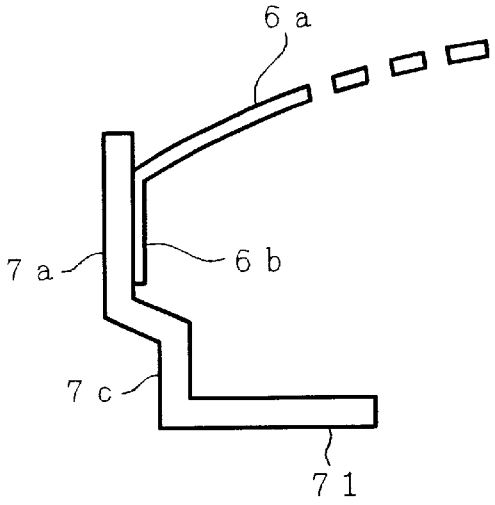
FIG. 5A is a diagrammatic view of a corner of a shadow mask assembly used for a color cathode ray tube of the present invention.
Figure 5B:
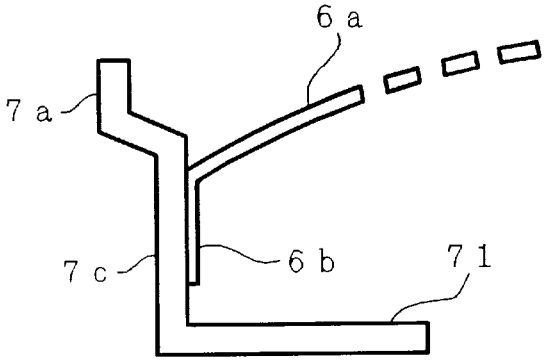
FIG. 5B is a diagrammatic view of a corner of a shadow mask assembly used for a color cathode ray tube of the present invention.
Figure 16A:
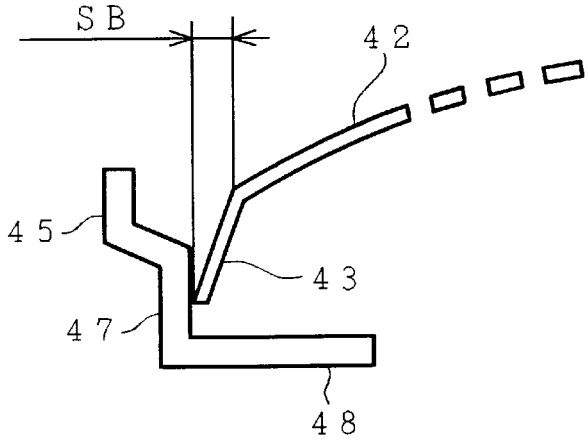
FIG. 16A (PRIOR ART)
FIGS. 16A and 16B are diagrammatic views of corners of the shadow mask assembly shown in FIG. 15.
Figure 16B:
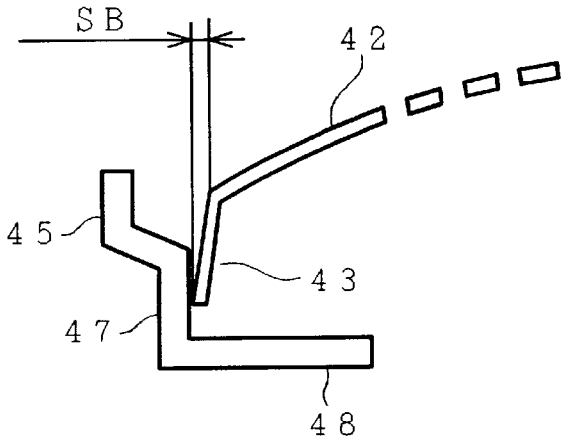
FIG. 16B (PRIOR ART)

Furthermore, in the case of the present invention, if it is necessary to form a boss at the corners for any reason, though the boss is normally unnecessary for the corners, it is possible to bring the whole of the skirt into contact with the side wall of the mask frame, as shown in FIGS. 5A and 5B. Thereby, it is possible to improve the coupling between the mask frame and the shadow mask. This is a point which is greatly different from the corner of the prior art arrangement seen in FIG. 16B.

Figure 6:
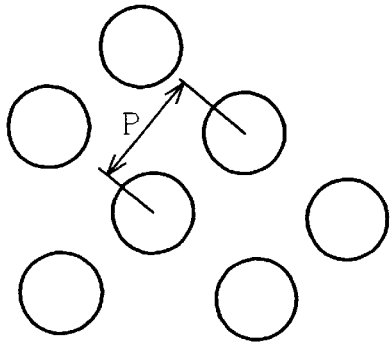
FIG. 6 is a diagram showing an arrangement of electron beam passing holes of a shadow mask used for a color cathode ray tube of the present invention.

FIG. 6 shows some of the electron-beam passing holes arranged on a shadow mask. It is possible to obtain a more minute image as the shadow mask pitch P decreases. However, if the shadow mask pitch decreases, the electron beam landing tolerance decreases and a phenomenon occurs in which one electron beam hits phosphors of a plurality of colors to easily cause luminescence (so-called multi-color hitting). This phenomenon is referred to as purity deterioration. The purity deterioration problem is greatly influenced by geomagnetism and particularly is frequently caused at the corners of a screen where the deflection angle of an electron beam increases.

According to the present invention, because the magnetic shielding effect is improved at the corners, it is possible to realize a fine-pitch color cathode ray tube with a shadow mask pitch P of 0.28 mm or less.

Figure 7A:
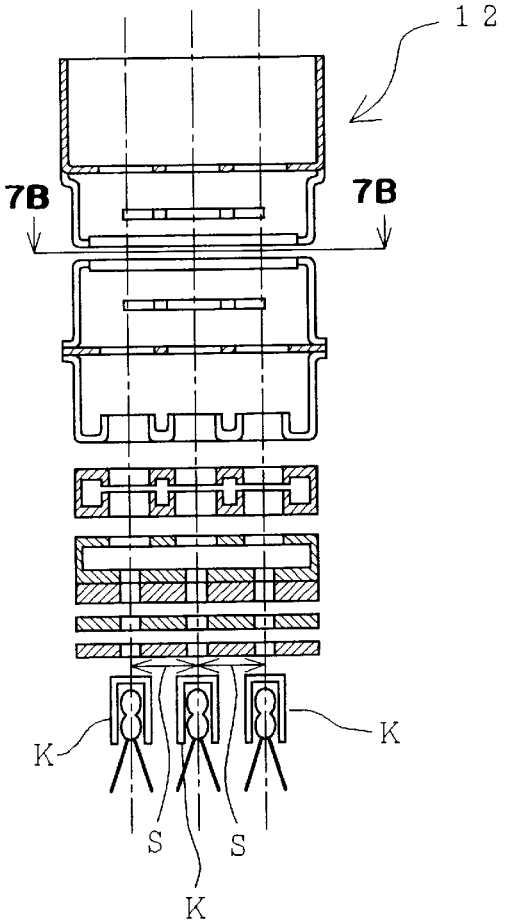
FIG. 7A is a sectional view of an electron gun used for a color cathode ray tube of the present invention in the in-line direction.
Figure 7B:
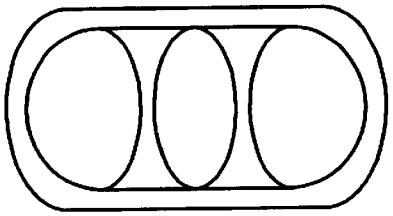
FIG. 7B is a sectional view of the electron gun shown in FIG. 7A vertical to the axis of the electron gun shown in FIG. 7A.

FIG. 7A shows an electron gun. FIG. 7B is a schematic view of a cathode K viewed from the line 7B—7B in FIG. 7A. The electron gun 12 is a so-called large-diameter electron gun in which electrodes having a common envelope face three electron beams in a main lens. The electron gun has a characteristic that the convergence and focus are improved as the interval S between the three electron beams decreases. However, if the dimension S of the electron gun is decreased, the interval Q between the inside surface of the panel and the shadow mask shown in FIG. 4A or 4B increases and a problem occurs in that the purity is deteriorated due to geomagnetism.

The present invention makes it possible to secure a sufficient landing tolerance even if the dimension S between electron guns is 5.5 mm or less because the magnetic shielding effect is improved at a corner where this type of problem frequently occurs.

In this case, the dimension S denotes a dimension along the surface of a cathode as shown in FIG. 7A.

Moreover, when the shadow mask pitch P is 0.28 mm, it is possible to secure the necessary purity tolerance even if the dimension S is 5.0 mm or less.

In the case of this embodiment, the skirt 6*b* is press-molded so that the central portion of each of the four corners $6b_1$, $6b_2$, $6b_3$, and $6b_4$ of the skirt 6*b* is curved slightly inward from a side close to the corners formed by the four sides. The above advantage can also be obtained by applying the molding of this embodiment only to the two facing sides $6b_1$ and $6b_3$ (or $6b_2$ and $6b_4$) of the skirt 6*b* and applying molding according to a well-known mode to the two remaining facing sides $6b_2$ and $6b_4$ (or $6b_1$ and $6b_3$) of the skirt 6*b* instead of applying the molding of this embodiment to the four sides $6b_1$, $6b_2$, $6b_3$, and $6b_4$ of the skirt 6*b*.

As described above, according to the present invention, it is possible to relatively increase the clearances of the central portions of the joint areas between the four sides of the skirt of a shadow mask and the side walls of the four sides to which a mask frame corresponds and to relatively decrease the clearances at the corners in a shadow mask assembly. Therefore, advantages can be obtained in that it is possible to sufficiently secure the contact area between a skirt and a side wall at a corner and it is unnecessary to set a boss in each corner of the side wall.

Moreover, according to the present invention, because it is unnecessary to set a boss in each corner of a side wall, the curved surface of a shadow mask is substantially expanded at the corners and thereby, the effective region of the curved surface can be expanded. Furthermore, because the contact area between the skirt and the side wall has been increased at the corners, an advantage can be obtained in that it is possible to improve the magnetic shielding characteristic at the corners of a shadow mask assembly.

Particularly in the case of a horizontally-long color cathode ray tube with a panel aspect ratio of 16:9 or 16:10, it is possible to greatly improve the focus characteristic by employing the present invention because the focus typically is deteriorated at the corners.

Second Embodiment

Figure 8:
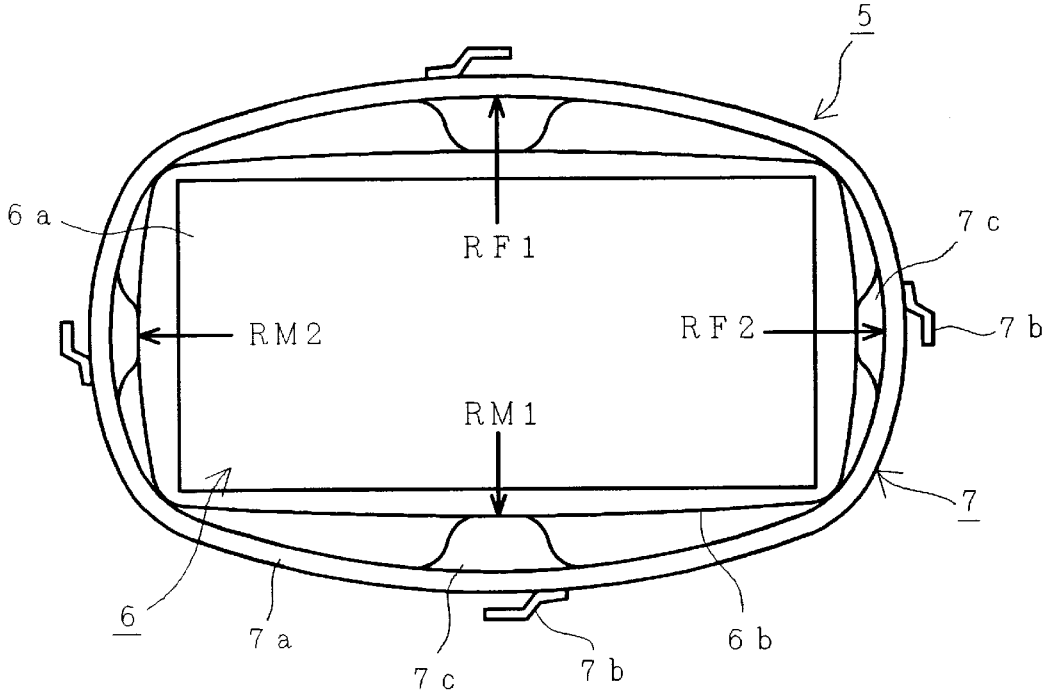
FIG. 8 is a top view showing another embodiment of a shadow mask assembly used for a color cathode ray tube of the present invention.

FIG. 8 is a top view of a shadow mask assembly forming a second embodiment of the present invention. Symbol RF1 denotes the radius of curvature of a major side of the inside of a side wall, RM1 denotes the radius of curvature of the margin of a shadow mask, RF2 denotes the radius of curvature of a minor side of the inside of the side wall, and RM2 denotes the radius of curvature of a minor side of the margin of the shadow mask. Other portions which are the same as those in FIG. 3 are provided with the same symbols.

In the case of this embodiment, the radius of curvature RF1 or RF2 of the inside of the side wall on a side of the mask frame 7 is set to a value smaller than the radius of curvature RM1 or RM2. According to this embodiment, it is possible to relatively increase the clearances of the central portions of the joint areas between the four sides of the skirt of a shadow mask and the four side walls to which a mask frame corresponds and to relatively decrease the clearances at the corners in a shadow mask assembly. Moreover, it is possible to retain the assembling mass productivity of a shadow mask and a mask frame even when increasing the clearance between the skirt of the shadow mask and the inside of the side wall of the mask frame at a side portion thereof, while decreasing the clearance at a corner.

That is, the shadow mask is provided with a curved surface having electron beam passing holes at its central portion and a skirt folded from the margin of the curved surface and extending in the tube axis direction. A top view obtained by projecting the margin of the curved surface on a plane transverse to the tube axis shows a substantially rectangular shape whose major or minor side is linear or has a curvature concave toward the tube axis and the radius of curvature is RM1 or RM2. Moreover, the mask frame is substantially rectangular, having a cross section which is almost L-shaped and which includes a side wall extending in the tube axis direction and a flange extending in the direction transverse to the tube axis. A top view obtained by projecting the inside of the fluorescent screen side of the side wall on a plane transverse to the tube axis shows a substantially rectangular shape whose major or minor side has a curvature concave toward the tube axis. Furthermore, the radius of curvature is RF1 or RF2, the relation between the above radii of curvatures meets the inequality RM1>RF1 or RM2>RF2, and the skirt of the shadow mask is secured to the side wall of the mask frame.

In this case, it is preferable to set the radii of curvatures of the major and minor sides so that the radius of curvature of the margin of the curved surface of the shadow mask is larger than them, that is, the inequalities RM1>RF1 and RM2>RF2 can be obtained. However, when either of the major and minor sides meets the above relation, the advantages of the present invention can be obtained.

Other structures, functions, and advantages of this embodiment are the same as those of the first embodiment.

Third Embodiment

Figure 9:
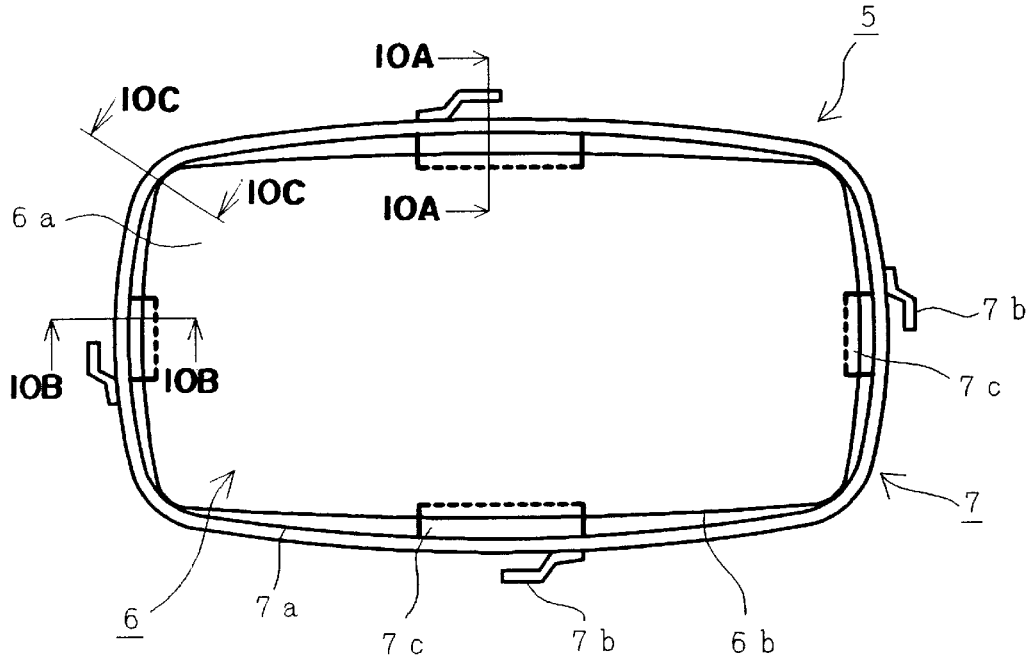
FIG. 9 is a top view showing still another embodiment of a shadow mask assembly used for a color cathode ray tube of the present invention.

FIG. 9 is a top view of the shadow mask assembly forming a third embodiment of the present invention. A portion which is the same as that in FIG. 3 is provided with the same symbol. In the case of this embodiment, the shadow mask 6 is made of invar. Because invar is hard, the skirt 6*b* is formed to be short.

Figure 10A:
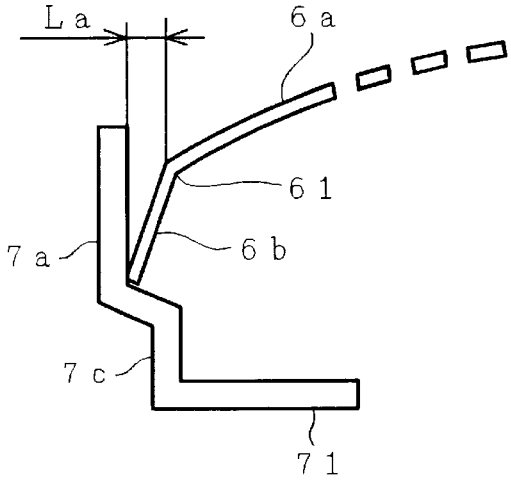
FIG. 10A is a diagrammatic view of a major side of the shadow mask assembly shown in FIG. 9.
Figure 10B:
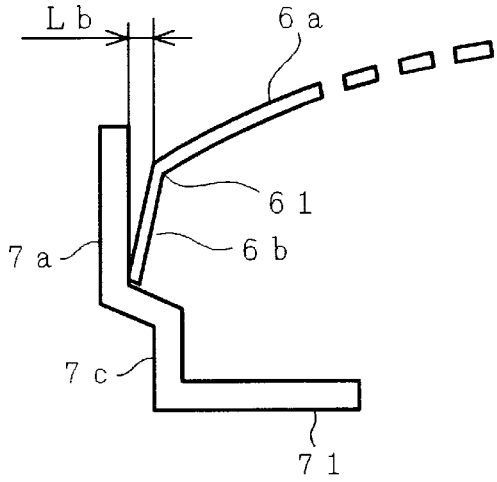
FIG. 10B is a diagrammatic view of a minor side of the shadow mask assembly shown in FIG. 9.
Figure 10C:
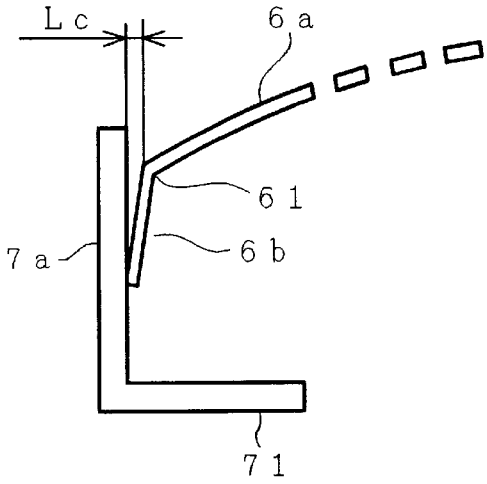
FIG. 10C is a diagrammatic view of a corner of the shadow mask shown in FIG. 9.

FIG. 10A shows a sectional view of the mayor side in FIG. 9, taken along the line 10A—10A in FIG. 9, FIG. 10B shows a sectional view of the minor side in FIG. 9, taken along the line 10B—10B in FIG. 9, and FIG. 10C shows a sectional view of the corner in FIG. 9, taken along the line 10C—10C in FIG. 9.

The feature of this embodiment is that the skirt 6*b* of the shadow mask is located more closely to the side wall of the mask frame than to the boss 7*c* formed at the proximal edge between the flange 71 and the side wall 7*a*, that is, the skirt 6*b* is located more closely to the fluorescent screen than to the boss 7*c* formed at the proximal edge. Thereby, even if the shirt 6*b* of the shadow mask made of invar is shortened, the operability is improved without the shadow mask reaching the flange 71 of the mask frame because the skirt 6*b* is located above the boss 7*c*. Moreover, the mechanical strength of the mask frame is improved by the boss 7*c*. In this case, a corner does not always require a boss.

That is, the shadow is provided with a curved surface having an electron beam passing hole at its central portion and a skirt folded from the margin of the curved surface and extending in the tube axis direction. Moreover, the mask frame is substantially rectangular, has a cross section which is almost L-shaped and which includes a wide wall extending in the tube axis direction and a flange extending transverse to the tube axis and has a boss including the proximal edge with the flange at its wide wall. Moreover, the skirt of the shadow mask is located more closely to the fluorescent screen than to any one of the bosses, including the proximal edge with the flange, and the shadow mask skirt is secured to the inside of the side wall of the mask frame.

Symbol La denotes the distance between the inside of the side-wall front end of the mask frame at a major side and the margin of the curved surface of the shadow mask, Lb denotes the distance between the inside of the side-wall front end of the mask frame at a minor side and the margin of the curved surface of the shadow mask, and Lc denotes the distance between the inside of the side-wall front end of the mask frame at a corner and the margin of the curved surface of the shadow mask. In the case of the distances between the inside of the side-wall front end of the mask frame and the margin of the curved surface of the shadow mask, it is preferable that the distance Lc at a corner is smaller than the distance La at a major side or the distance Lb at a minor side. This is the same as the case of the first or second embodiment. That is, because La or Lb is larger than Lc, the contact area at a corner increases.

Figure 11A:
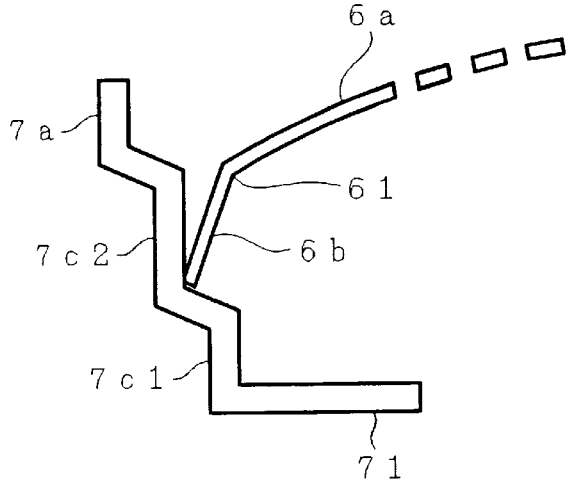
FIG. 11A is a diagrammatic view of a major side showing still another embodiment of the structure of a shadow mask assembly used for a color cathode ray tube of the present invention.
Figure 11B:
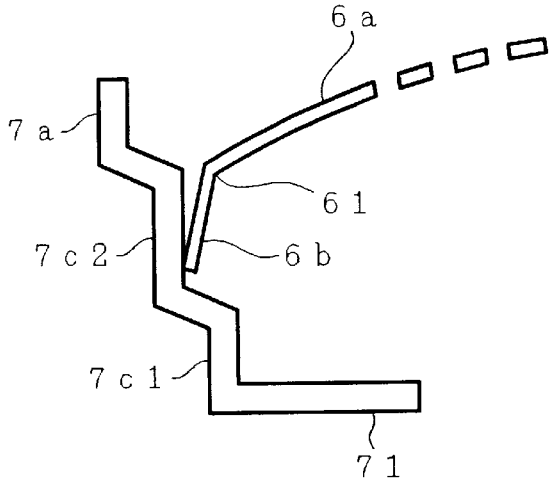
FIG. 11B is a diagrammatic view of a minor side showing still another embodiment of the structure of a shadow mask assembly used for a color cathode ray tube of the present invention.
Figure 11C:
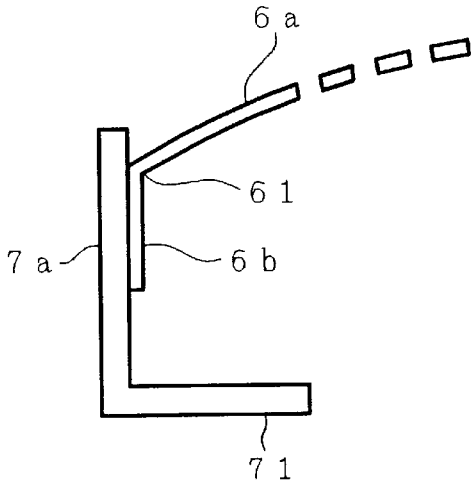
FIG. 11C is a diagrammatic view of a corner showing still another embodiment of the structure of a shadow mask assembly used for a color cathode ray tube of the present invention.

FIGS. 11A, 11B, and 11C are sectional views of a shadow mask assembly in which a boss of a mask frame is formed at two stages. FIG. 11A shows a sectional view of a major side, FIG. 11B shows a sectional and FIG. 11C shows a sectional view of a minor side, view of a corner. In the case of the major side shown in FIG. 11A and the minor side shown in FIG. 11B, a shallow boss 7*c*2 is formed above a deep boss 7*c*1 (fluorescent screen side). However, no boss is formed 11C. Moreover, the mask at the corner shown in FIG. frame 7 is welded with the shadow mask 6 by the shallow boss 7*c*2 on the major or minor side.

When a boss of the mask frame is formed at a plurality of stages, it is possible for the skirt of the shadow mask to be located above the deepest boss formed at the proximal edge of the side wall of the mask frame with the flange.

By combining the features of the third embodiment with those of the first and second embodiments, it is possible to obtain not only the above advantages, but also the advantages of the other embodiments.

Fourth Embodiment

Figure 12:
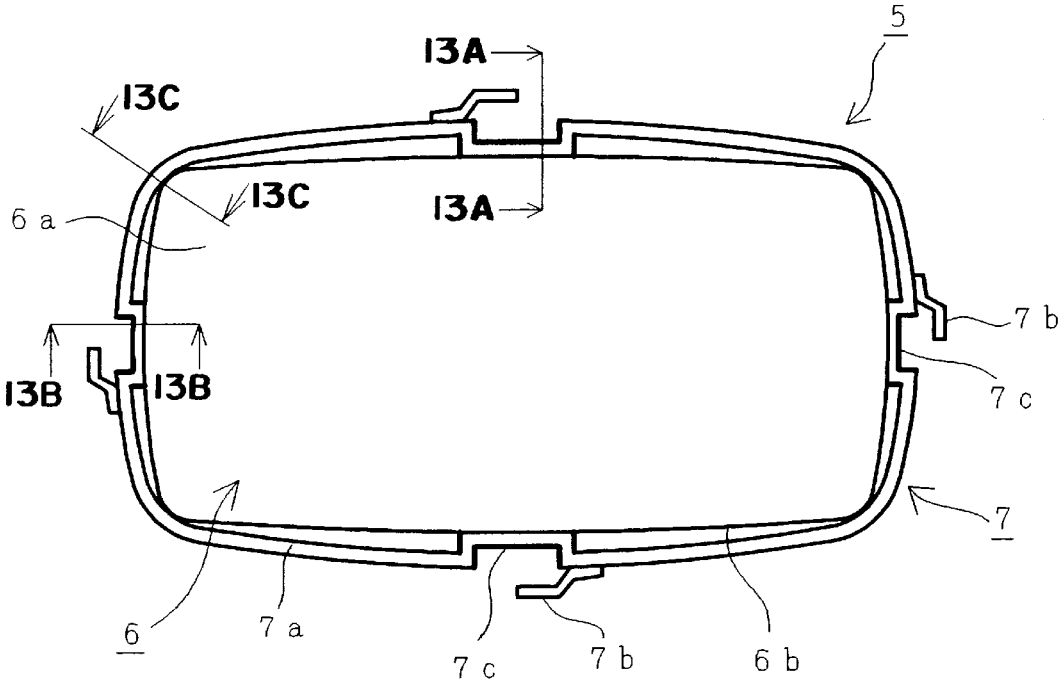
FIG. 12 is a top view showing still another embodiment of a shadow mask assembly used for the color cathode ray tube shown in FIG. 1.

FIG. 12 is a top view of a shadow mask forming a fourth embodiment of the present invention. A portion which is the same as that in FIG. 3 is provided with the same symbol. In the case of this embodiment, the shadow mask 6 is made of invar.

A feature of this embodiment is that the boss 7*c* formed at a side of a mask frame is formed on the side wall 7*a* so a to extend the full distance in the height direction. Thereby, it is possible to further improve the adhesion degree between the skirt 6*b* of the shadow mask and the inside of the side wall 7*a* of the mask frame at their joint (specifically, the skirt 6*b* and the inside of the side wall 7*a* are joined by spot welding). It inevitably becomes difficult to set the shadow mask in the mask frame because the boss 7*c* is formed up to the top of the side wall 7*a*. However, this is not a big problem because the region of the boss 7*c* is small.

Moreover, by forming a tapered portion T at the front end of the portion of the side wall 7*c* where the boss 7*c* is formed, it becomes easy to set the shadow mask in the mask frame.

That is, the shadow mask is provided with a curved surface having electron beam passing holes at its central portion and a skirt folded from the margin of the curved surface and extending in the tube axis direction. The mask frame is substantially rectangular, having a cross section which is L-shaped, and which includes a side wall extending in the tube axis direction and a flange extending transverse to the tube axis. The side wall is provided with a portion having a boss between the proximal edge with the flange and the fluorescent screen end of the side wall, and the skirt of the shadow mask is secured to the inside of the side wall of the mask frame.

Figure 13A:
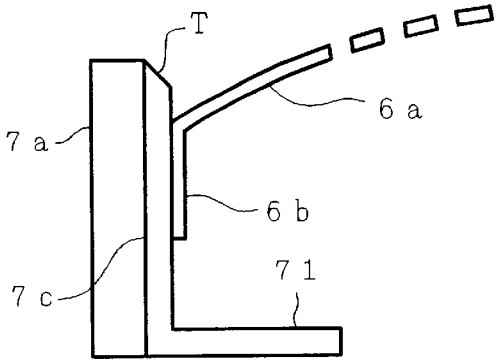
FIG. 13A is a diagrammatic view of a major side of the shadow mask assembly shown in FIG. 12.
Figure 13B:
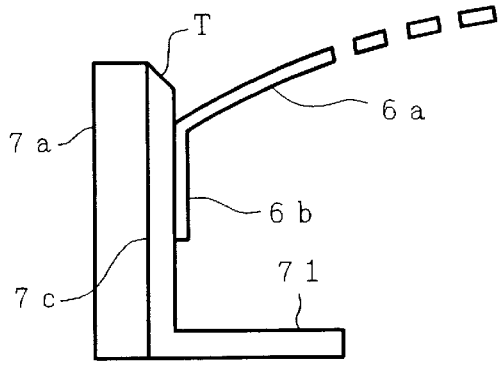
FIG. 13B is a diagrammatic view of a minor side of the shadow mask assembly shown in FIG. 12.
Figure 13C:
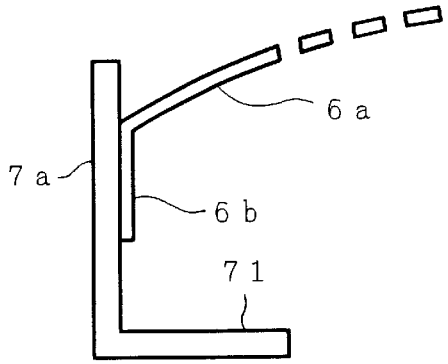
FIG. 13C is a diagrammatic view of a corner of the shadow mask assembly shown in FIG. 12.
Figure 13D:
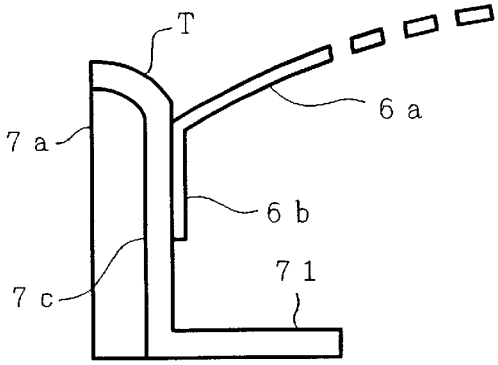
FIG. 13D is a diagrammatic view of another embodiment.

For example, FIG. 13A is a sectional view of the major side in FIG. 12, taken along the line 13A—13A in FIG. 12, in which the tapered portion T is formed at the front end of the portion of the side wall 7*a* where the boss 7*c* is formed. FIG. 13B is a sectional view of the minor side in FIG. 12, taken along the line 13B—13B in FIG. 12, in which the boss 7*c* is formed at the front end of the portion of the side wall 7*a* where the boss 7*c* is formed. FIG. 13C is a sectional view of the corner in FIG. 12, taken along the line 13C—13C in FIG. 12, in which a boss is not formed at the corner and so no tapered portion T is present. FIG. 13D is another example when the tapered portion T is formed, in which the top of the frame is tilted outward.

Figure 14A:
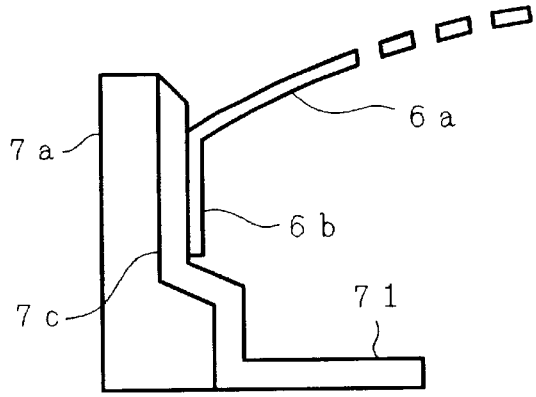
FIG. 14A is a diagrammatic view of a major side showing still another embodiment of the structure of a shadow mask assembly used for a color cathode ray tube of the present invention.
Figure 14B:
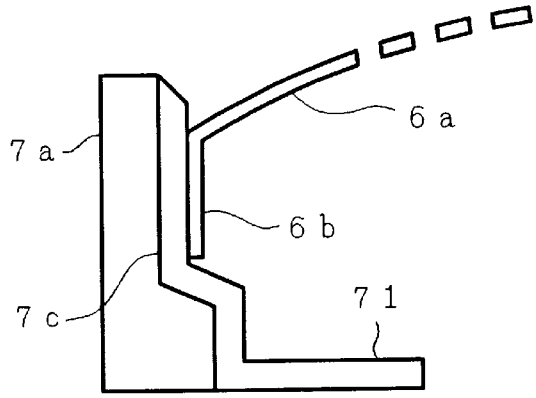
FIG. 14B is a diagrammatic view of a minor side showing still another embodiment of the structure of a shadow mask assembly used for a color cathode ray tube of the present invention.
Figure 14C:
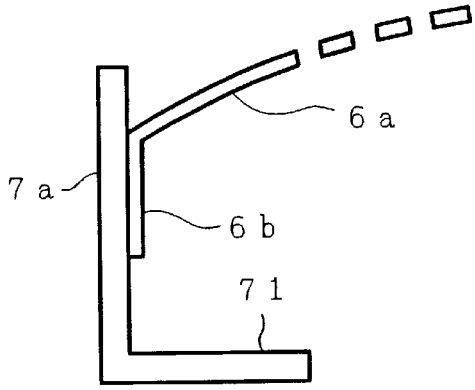
FIG. 14C is a diagrammatic view of a corner showing still another embodiment of the structure of a shadow mask assembly used for a color cathode ray tube of the present invention.
Figure 15:
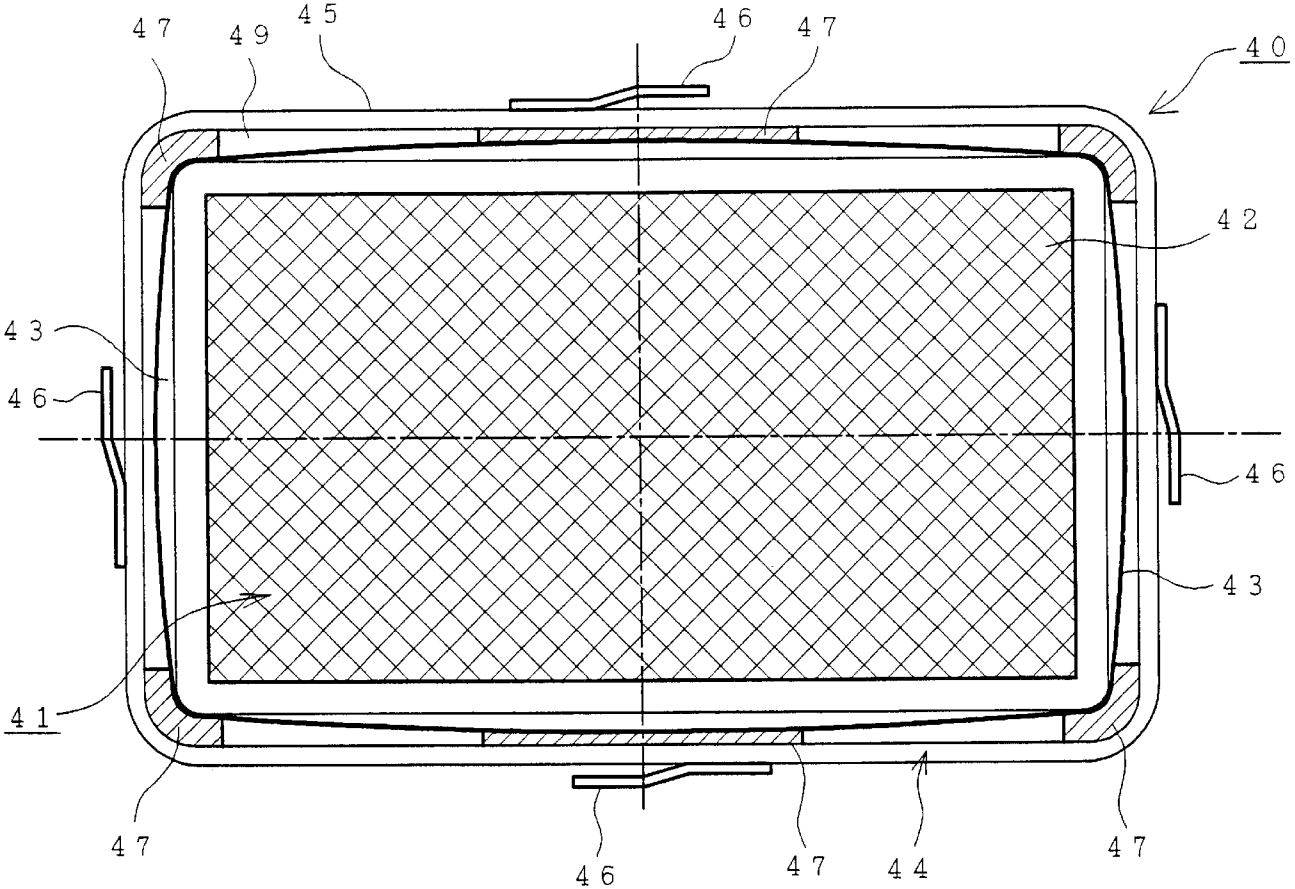
FIG. 15 (PRIOR ART)
FIG. 15 is a top view showing the structure of a shadow mask assembly used for a conventional color cathode ray tube.

FIG. 14A is a sectional view of a major side of a shadow mask assembly in which the depth of a boss has two stages, and in which a tapered portion T is formed at the front end of the portion of the side wall 7*a* where the boss is formed. FIG. 14B is a sectional view of a minor side of a shadow mask assembly in which the depth of a boss has two stages, and in which a tapered portion T is formed at the front end of the portion of the side wall 7*a* where the boss is formed. FIG. 14C is a sectional view of a corner of a shadow mask assembly in which no boss is formed at the corners and no tapered portion T is present. The advantage of a boss whose depth has two stages has been described in connection with the third embodiment.

Furthermore, by combining the features of the fourth embodiment with those of the above-described first, second, and third embodiments, it is possible to obtain not only the above advantages, but also the advantages of those other embodiments.

What is claimed is:

1. A color cathode ray tube comprising a tubes including a panel on which a fluorescent screen is formed, a neck including an electron gun, and a funnel for connecting the panel and the neck in the tube axis direction; and a shadow mask assembly and an inner shield provided for the shadow mask assembly, both of which are disposed within the tube; wherein:

the shadow mask assembly includes a shadow mask made of invar, a mask frame, and a spring for mounting the shadow mask assembly in the panel;

the shadow mask has a curved surface having electron beam passing holes and a skirt folded from the margin of the curved surface and extending in the tube axis direction;

the mask frame is substantially rectangular, the cross section of which is substantially L-shaped, and which mask frame includes a side wall extending in the tube axis direction and a flange extending transverse to the tube axis; and the side wall is provided with bosses including a proximal edge with a flange, the shadow-mask skirt is located more closely to the fluorescent screen than to any one of the bosses, and the shadow-mask skirt is secured to the inside of the mask-frame side wall.

2. A color cathode ray tube according to claim 1, wherein the mask-frame side wall has a first boss including a proximal edge between the side wall and a flange and a second boss formed at substantially the same position in the frame circumference direction and more closely to the fluorescent screen than to the first boss and having a depth smaller than that of the first boss, and the skirt of a shadow mask is present at the fluorescent screen side of the first boss.

3. A color cathode ray tube according to claims 1 or 2, wherein the bosses are not present at the corners of the mask frame.

4. A color cathode ray tube according to claim 1, wherein a top view obtained by projecting the shadow-mask margin on a plane transverse to the tube axis shows a substantially rectangular shape in which at least one of the major and minor sides thereof have a curvature convex to the tube axis, and a major or minor side in a top view obtained by projecting the inside of the fluorescent screen end of the mask-frame side wall on a plane transverse to the tube axis is linear or has a curvature concave to the tube axis.

5. A color cathode ray tube according to claim 1, wherein a top view obtained by projecting the shadow-mask margin on a plane transverse to the tube axis shows a substantially rectangular shape in which at least one of the major and minor sides thereof have a curvature convex to the tube axis, and a major or minor side in a top view obtained by projecting the inside of the fluorescent screen end of the mask-frame side wall in a direction transverse to the tube axis is linear or has a curvature concave to the tube axis.

6. A color cathode ray tube according to claim 1, wherein a top view obtained by projecting the shadow-mask margin on a plane transverse to the tube axis shows a substantially rectangular shape in which at least one of the major and minor sides are linear or have a curvature concave to the tube axis and each curvature is one of RM1 and RM2, a top view obtained by projecting the inside of the fluorescent screen end of the mask-frame side wall on a plane transverse to the tube axis shows a substantially rectangular shape in which at least one of the major and minor sides have a curvature concave to the tube axis and each radius of curvature is one of RF1 and RF2, and the relation between the radii of curvatures meets one of the inequalities RM1>RF1 and RM2>RF2.

7. A color cathode ray tube according to claim 1, wherein a top view obtained by projecting the shadow-mask margin on a plane transverse to the tube axis shows a substantially rectangular shape in which at least one of the major and minor sides are linear or have a curvature concave to the tube axis and each curvature is one of RM1 and RM2, a top view obtained by projecting the inside of the fluorescent screen end of the mask-frame side wall on a plane transverse to the tube axis shows a substantially rectangular shape in which at least one of the major and minor sides have a curvature concave to the tube axis and each radius of curvature is one of RF1 and RF2, and the relation between the radii of curvatures meets the inequalities RM1>RF1 and RM2>RF2.

8. A color cathode ray tube according to claim 1, wherein the distance between the shadow-mask margin and the inside of the mask-frame side wall in direction transverse to the tube axis is smaller at the corners than at the major or minor side of the substantially rectangular shape.

9. A color cathode ray tube according to claims 1, 2, or 7, wherein the electron beam passing holes of the shadow mask are round holes, the pitch between the holes is 0.28 mm or less, and the interval between three electron beams of the electron gun for generating three electron beams is 5.5 mm or less on the cathode surface.

10. A color cathode ray tube comprising a tube, including a panel on which a fluorescent screen is formed, a neck including an electron gun, and a funnel for connecting the panel and the neck in the tube axis direction; and a shadow mask assembly and an inner shield provided for the shadow mask assembly, both of which are disposed within the tube; wherein:

the shadow mask assembly includes a shadow mask made of invar, a mask frame, and a spring for mounting the shadow mask assembly in the panel;

the shadow mask has a curved surface having electron beam passing holes and a skirt folded from the margin of the curved surface and extending in the tube axis direction;

the mask frame is substantially rectangular, the cross section of which is substantially L-shaped, and which mask frame includes a side wall extending in the tube axis direction and a flange extending transverse to the tube axis; and the side wall is provided with a portion having a boss between the proximal edge with a flange and the fluorescent screen end of the side walls and the shadow-mask skirt is secured to the inside of the mask-frame side wall.

11. A color cathode ray tube according to claim 10, wherein the mask-frame side wall has a first boss including a proximal edge between the side wall and a flange and a second boss formed at substantially the same position in the frame circumference direction and more closely to the fluorescent screen than to the first boss and having a depth smaller than that of the first boss, the skirt of a shadow mask is present at the fluorescent screen side of the first boss, and the shadow-mask skirt is located more closely to the fluorescent screen than to the first boss.

12. A color cathode ray tube according to claims 10 or 11, wherein bosses are not present at corners of the mask frame.

13. A color cathode ray tube according to claims 10 or 11, wherein a tapered portion is formed at the fluorescent screen end of a boss and extends up to the fluorescent screen end of the mask-frame side wall toward the inside of the mask frame.

14. A color cathode ray tube according to claim 10, wherein a top view obtained by projecting the shadow-mask margin on a plane transverse to the tube axis shows a substantially rectangular shape in which at least one of the major and minor sides have a curvature convex to the tube axis, and a major or minor side in a top view obtained by projecting the inside of the fluorescent screen end of the mask-frame side wall on a plane transverse to the tube axis is linear or has a curvature concave to the tube axis.

15. A color cathode ray tube according to claim 10, wherein a top view obtained by projecting the shadow-mask margin on a plane transverse to the tube axis shows a substantially rectangular shape in which at least one of the major and minor sides thereof have a curvature convex to the tube axis, and a major or minor side in a top view obtained by projecting the inside of the fluorescent screen end of the mask-frame side wall in a direction transverse to the tube axis is linear or has a curvature concave to the tube axis.

16. A color cathode ray tube according to claim 10, wherein a top view obtained by projecting the shadow-mask margin on a plane transverse to the tube axis shows a substantially rectangular shape in which at least one of the major and minor sides thereof are linear or have a curvature concave to the tube axis, each radius of curvature is one of RF1 and RF2, a top view obtained by projecting the inside of the fluorescent surface end of the mask-frame side wall on a plane transverse to the tube axis shows a substantially rectangular shape in which at least one of the major and minor sides thereof have a curvature concave toward the tube axis and each radius of curvature is one of RF1 and RF2, and the relation between the radii of curvatures meets one of the inequalities RM1>RF1 and RM2>RF2.

17. A color cathode ray tube according to claim 10, wherein a top view obtained by projecting the shadow-mask margin on a plane transverse to the tube axis shows a substantially rectangular shape in which at least one of the major and minor sides thereof are linear or have a curvature concave to the tube axis and each radius of curvature is one of RM1 and RM2, and a top view obtained by projecting the inside of the fluorescent screen end of the mask frame side wall on a plane transverse to the tube axis shows a substantially rectangular shape in which at least one of the major and minor sides thereof are linear or have a curvature concave to the tube axis and each radius of curvature is one of RF1 and RF2, and the relation between the radii of curvatures meets the inequalities RM1>RF1 and RM2>RF2.

18. A color cathode ray tube according to claims 10, 11, 14, or 16, wherein the distance between the shadow-mask margin and the inside of the mask-frame side wall in a direction transverse to the tube axis is smaller at the corners than at the major or minor axis of the substantially rectangular shape.

19. A color cathode ray tube according to claims 10, 11, 14, or 16, wherein the electron beam passing holes in the shadow mask are round holes, the pitch between the holes is 0.28 mm or less, and the interval between three electron beams of the electron gun for generating three electron beams is 5.5 mm or less on the cathode surface.

20. A color cathode ray tube comprising a tube, including a panel on which a fluorescent screen is formed, a neck including an electron gun, and a funnel for connecting a panel and a neck in the tube axis direction; and a shadow mask assembly and an inner shield provided for the mask assembly, both of which are disposed within the tube; wherein:

the shadow mask assembly includes a shadow mask, a mask frame, and a spring for mounting the shadow mask assembly in the panel;

the shadow has a curved surface having electron beam passing holes and a skirt folded from the margin of the curved surface and extending in the tube axis direction;

the mask frame is substantially rectangular, the cross section of which is substantially L-shaped, and which mask frame includes a side wall extending in the tube axis direction and a flange extending transverse to the tube axis direction;

the skirt of the shadow-mask is secured to the inside of the side wall of the mask-frame; and at least one of (a) the side wall is provided with a portion having a boss between a proximal edge with a flange and a flourescent screen end of the side wall, (b) the side wall is provided with bosses including a proximal edge with a flange, and the skirt of the shadow-mask is located more closely to the flourescent screen than to any one of the bosses, and (c) a top view obtained by projecting the margin of the curved surface of the shadow-mask on a plane transverse to the tube axis shows a substantially rectangular shape in which at least one of the major and minor sides thereof have a curvature convex to the tube axis, and a top view obtained by projecting the inside of the flourescent screen end of the side wall on a plane transverse to the tube axis shows a substantially rectangular shape in which at least one of the major and minor sides thereof are linear or have a curvature concave to the tube axis.

21. A color cathode ray tube according to claim 20, wherein the shadow-mask is made of invar.

* * * * *